US006357539B1

(12) United States Patent
Ruttley

(10) Patent No.: US 6,357,539 B1
(45) Date of Patent: Mar. 19, 2002

(54) APPARATUS FOR RETRIEVING METAL OBJECTS FROM A WELLBORE

(75) Inventor: David J. Ruttley, Marrero, LA (US)

(73) Assignee: Rattler Tools, Inc., Harvey, LA (US)

( * ) Notice: Subject to any disclaimer, the term of this patent is extended or adjusted under 35 U.S.C. 154(b) by 0 days.

(21) Appl. No.: 09/602,379

(22) Filed: Jun. 22, 2000

Related U.S. Application Data

(62) Division of application No. 09/422,423, filed on Oct. 21, 1999, now Pat. No. 6,216,787.

(51) Int. Cl.[7] ..... E21B 10/00; E21C 25/04
(52) U.S. Cl. ..... 175/328; 166/66.5
(58) Field of Search ..... 166/66.5, 311; 175/328

(56) References Cited

U.S. PATENT DOCUMENTS 3,637,033 A * 1/1972 Mayall ..... 175/320
4,113,611 A * 9/1978 Gohm ..... 209/215

* cited by examiner

*Primary Examiner*—Ramon M. Barrera
(74) *Attorney, Agent, or Firm*—Keaty Professional Law Corporation

(57) ABSTRACT

A tool for retrieving metal objects from a wellbore has a plurality of magnet assemblies spaced longitudinally along a tool body. Each magnet assembly has a plurality of magnet members, which can be arcuate or longitudinal, covering a majority surface area of the tool body. In the embodiment of the invention having longitudinal members, magnet protectors are secured immediately adjacent to a corresponding magnet member for deflecting striking force of the metal particles being attracted to the magnet during rotation of the tool. A trap space if formed between the magnet and an adjacent magnet protector for retaining more metal particles within the magnet assemblies.

6 Claims, 3 Drawing Sheets

APPARATUS FOR RETRIEVING METAL OBJECTS FROM A WELLBORE

CROSS-REFERENCE TO RELATED APPLICATIONS

This application is a divisional application of my application Ser. No. 09/422,423 filed on Oct. 21, 1999 now U.S. Pat. No. 6,216,787 entitled "An Apparatus for Retrieving Metal Objects from a Wellbore", the full disclosure of which is incorporated by reference herein.

BACKGROUND OF THE INVENTION

The present invention relates to wellbore tools and more particularly to an apparatus for retrieval of metal objects, such as cuttings and other foreign objects that accumulate in the process of perforating or milling over bridge plugs and other down hole obstructions from a wellbore.

Various types of bridge plugs are conventionally used in the oil and gas industry. These bridge plugs are installed in the annulus and are often covered in cement. Removal of such plugs can sometimes pose a problem for the industry. A rotary bit drills the cement and plugs out, while some of the cuttings of the plugs are carried out to the surface by a liquid circulated down hole.

Sometimes, a production packer needs to be removed together with the metal pipe that it surrounds. In those cases, milling tools with gravity fed boot baskets are used for retrieving pieces of metal from the wellbore. After retrieval of the production packer, it may become necessary to run a conventional fishing magnet to retrieve additional junk and cuttings.

A conventional fishing magnet is mounted inside a housing that is lowered into a wellbore. It is limited in the ability to retrieve cuttings in that its magnetization is restricted to the extreme bottom surface of the magnet. The fact that circulating fluids lift the cuttings away from the bottom surface of the magnet renders that conventional fishing magnet useless in this situation.

Often times, a boot basket is used for collecting cuttings that did not attach themselves to the conventional magnet. A boot basket has small openings for catching these particles. Consequently, many large size pieces or very small pieces suspended in the fluid flow are not trapped in the basket and remain in the wellbore.

The present invention contemplates elimination of drawbacks associated with the prior art and provision of a wellbore apparatus for removal of metal objects, such as cuttings, and other foreign particles that provides for the use of sets of magnets spaced longitudinally along the tool body.

SUMMARY OF THE INVENTION

It is, therefore, an object of the present invention to provide an apparatus for retrieval of metal cuttings and other foreign objects from a wellbore.

It is another object of the present invention to provide a packer-milling tool with magnets set in a spaced relationship longitudinally along the tool body to increase "catching" capacity of the tool.

These and other objects of the invention are achieved through a provision of an apparatus for removal of metal cuttings and other foreign objects from a wellbore that uses at least two magnet assemblies vertically spaced from each other and mounted on the body of the tool. Each magnet assembly is comprised of a plurality of magnets encircling the body of the tool and covering a surface area greater than one half of the tool body.

One of the embodiments of the invention provides for arcuate in cross section magnet members that are detachably secured on the tool body. The second embodiment provides for trapezoidal in cross section magnet members that extend longitudinally in parallel relationship to a central axis of the tool body. The tool of the second embodiment further provides for magnet protectors mounted adjacent to each magnet member. Each magnet protector has a triangular cross section and has a slanted surface that is angled in the direction of rotation.

The space between each magnet and the next adjacent magnet protector forms a "trap" that receives and retains metal particles pushed away by the leading surface of the adjacent magnet member. Consequently, the capability of the tool to retain cuttings for subsequent retrieval to the surface is significantly increased in comparison with conventional magnet tools.

BRIEF DESCRIPTION OF THE DRAWINGS

Reference will now be made to the drawings, wherein like parts are designated by like numerals and wherein.

DETAIL DESCRIPTION OF THE PREFERRED EMBODIMENTS

Figure 1:
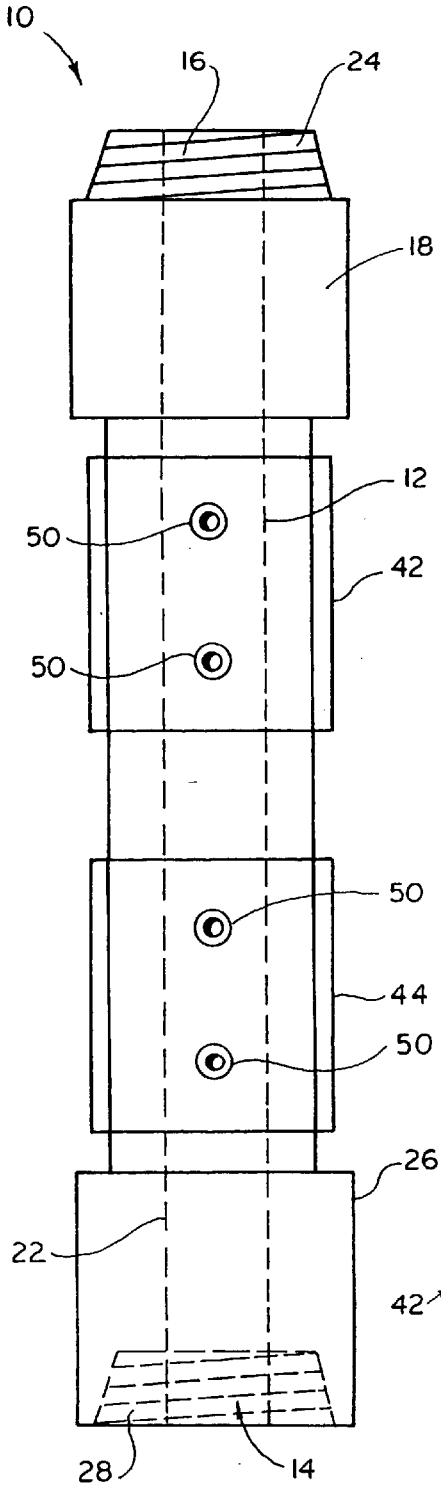
FIG. 1 is a side view of the packer removal tool of the present invention.

Turning now to the drawings in more detail, numeral 10 designates the well bore apparatus in accordance with the present invention. The apparatus 10 comprises a generally cylindrical body 12 provided with a central through opening 14. The circulating fluids are admitted into the central opening 14 from an upper end 16 of the body 12.

An upper sub 18 is fixedly secured in circumferential relationship about the body 12 adjacent the upper end 16, and a lower sub 20 is secured in circumferential relationship about the body 12 adjacent a lower end 22. The upper sub 18 is provided with external threads 24 and the lower sub 26 is provided with internal threads 28. The threads 24 allow connection of the tool 10 to a bumper jar 30 schematically shown in FIGS. 6 and 7. The bumper jar 30 is conventionally mounted on a drill string above the junk and cuttings removal tools.

Figure 6:
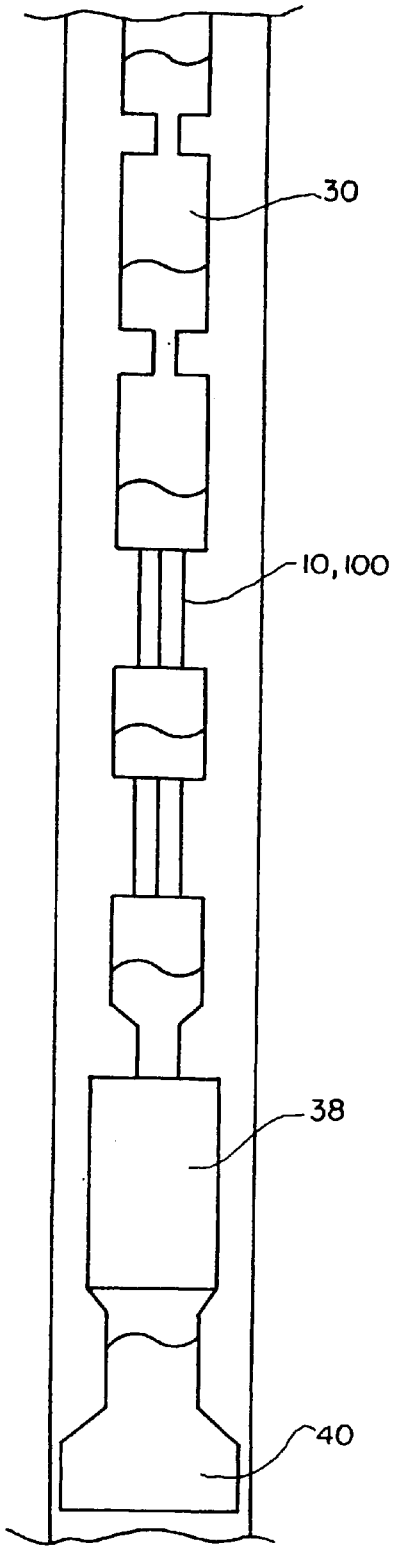
FIG. 6 is a schematic view showing position of the apparatus of the present invention in combination with a conventional milling tool.
Figure 7:
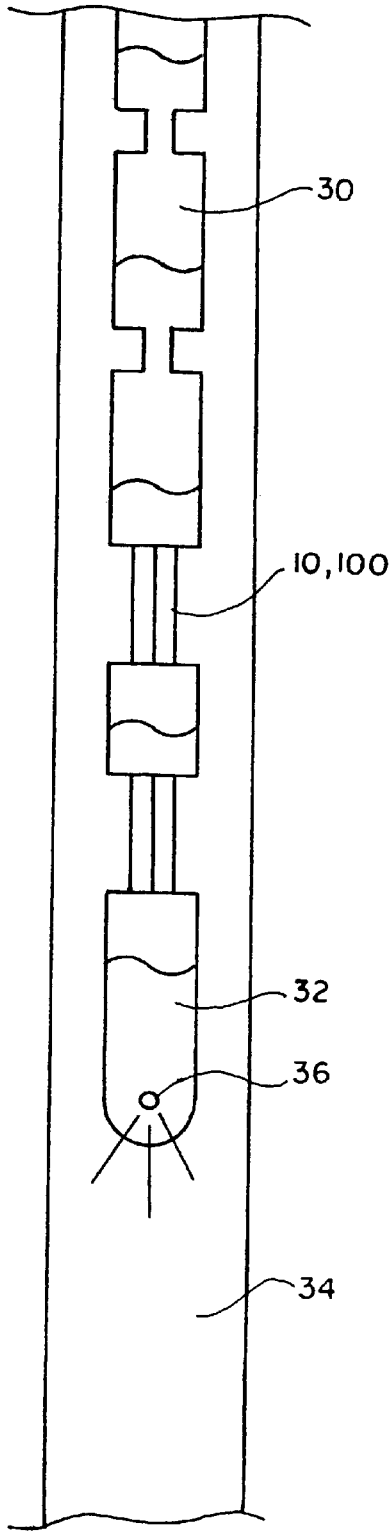
FIG. 7 is a schematic view showing the apparatus of the present invention in combination with a ported jet sub for admitting a circulating fluid.

The internal threads 28 on the lower sub 26 can be used for attaching the apparatus 10 to a jet sub 32 for admitting circulating liquid into a wellbore 34 (FIG. 7). The liquid exits the jet sub 32 through one or more openings, or ports 36 formed in the sub 32. Alternatively, the internal threads 28 may be used for attaching the tool 10 to a boot basket 38 (FIG. 6). The boot basket 38 conventionally carries at its lower end a milling tool 40 (FIG. 6).

Mounted between the subs 18 and 20 are two sets of magnet assemblies 42 and 44. Of course, more than two sets of magnet assemblies may be provided on the drill string, if desired. The upper magnet assembly 42 is vertically spaced from the lower magnet assembly 44.

Figure 2:
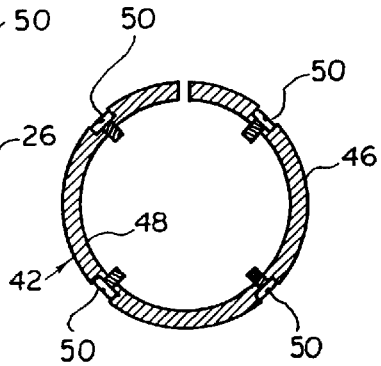
FIG. 2 is a cross-sectional view of the magnet used in the tool of the present invention.

Each magnet assembly 42 and 44 comprises a plurality of arcuate magnets 46 and 48 (FIG. 2) that are detachably secured to the body 12 by screws 50 or other similarly suitable means. When positioned on the body 12, the magnets 46 and 48 resemble a cylindrical sleeve having an inner diameter slightly greater than an outside diameter of the body 12. The magnet assemblies 42 and 44, occupying a large surface of the tool 10, allow retrieval of a significantly greater amount of metal pieces from the wellbore 34.

Figure 4:
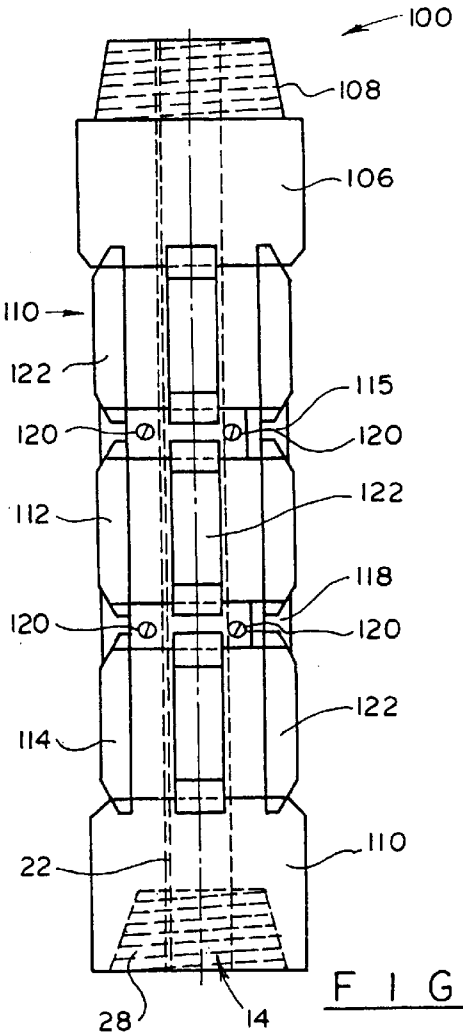
FIG. 4 is a detail view of the second embodiment of the present invention showing three vertically spaced magnet assemblies.
Figure 3:
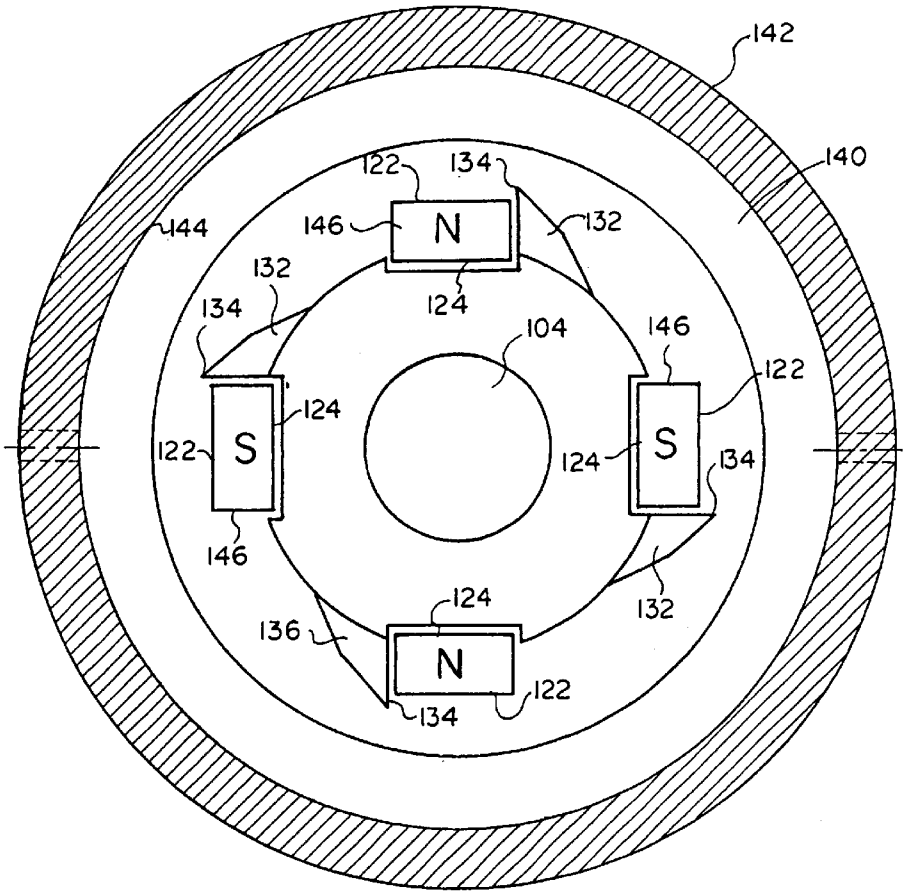
FIG. 3 is a top view of the tool of the second embodiment of the present invention lowered into the wellbore.

Turning now to the second embodiment of the present invention, the tool 100 comprises a cylindrical body 102 having a through opening 104 for admitting circulating fluid into the wellbore 34. An upper sub 106 has external threads 108. The upper sub 106 and a lower sub 110 (partially shown in FIG. 4) are used in a manner similar to that of the subs 18 and 26 of the first embodiment of the present invention.

Mounted between the subs 106 and 108 are magnet assemblies 110, 112 and 114. The are vertically spaced from each other and separated by retainer rings 116 and 118. The retainer rings 116 and 118 are split rings provided with locking members 120 for securing the magnets on the body 102. The retainer rings 116 and 118 also help in retrieving of heavy shrapnel by creating a "stop," thereby preventing a sliding and/or flushing effect.

Figure 5:
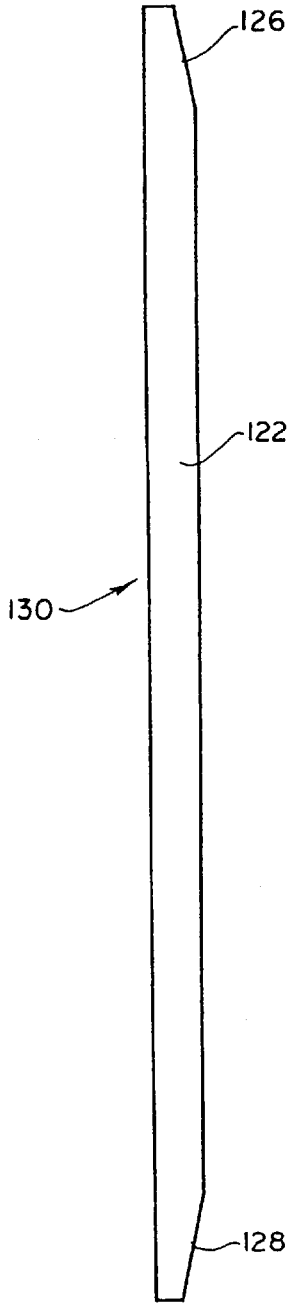
FIG. 5 is a magnet profile suitable for use in the second embodiment of the present invention.

As can be seen in the drawings, magnet assemblies 110, 112 and 114 comprise a plurality of individual magnets 122. The magnets 122 have "north" and "south" members, attracting variously charged metal cuttings. A portion of each magnet 122 fits into a specially provided slot 124 formed in the body 102. As shown in FIG. 5, each magnet 122 has a trapezoidal cross-section with slanted opposite ends 126 and 128. A longer side 130 fits into the groove 124.

Each magnet 122 is provided with a "heel," or magnet protector 132. Each protector member 132 has a triangular cross-section with one side 134 of the protector being longer than the side of the magnet 122 positioned next to it. The slanted side 136 of the protector is angled in the direction of rotation of the tool 100.

When cuttings appear in an annulus 140 of a casing 142 the magnet protectors tend to deflect the striking force of the metal cuttings away from the magnet surfaces and cause them to strike the inside wall 144 of the casing 142. The cuttings are then pushed upwardly. The cuttings then attach themselves to the magnets 122 and can be carried to the surface when the tool 100 is retrieved.

Some of the cuttings fall between the magnets 122 and they are caught in a trap that is formed between a straight side 146 of one magnet and the slanted face 136 of the next magnet protector. The cuttings accumulate within this trap space and are held there until milling is finished and the tool 100 is retrieved. The heel portion of the magnet protector acts as a "skid" to allow continues forcing of the cuttings into a magnetic field created by adjacent magnets.

This procedure is different from conventional methods, where a mule shoe first removes small particles and then cutting or milling is performed. The apparatus of the present invention allows performing several procedures in one step. It is possible to still use a cuttings boot basket, if desired for maximum removal of cuttings, although experiments performed with the apparatus of the present invention demonstrated a significantly high cutting removal rate.

The tool of the present invention is particularly advantageous in horizontal or directional drilling where gravity-assisted cuttings collection is not available. The tool of the present invention, by attracting the cuttings and holding them in "traps" facilitates a greater rate of cuttings removal than was available before.

The number of individual magnets 122 in a magnet assembly can vary. Normally, four or five magnets work satisfactorily when equidistantly spaced about the circumference of the body 102. During rotation of the tool 100, the magnets provide an almost 360 degree coverage and create a strong magnetic field for attracting metal cuttings and miscellaneous items.

In conventional operations, the first step is usually to remove sand or small soil particles that accumulated on top of a packer. Using a drill stem to lower a circulating pipe with an angularly cut nozzle to the depth where the packer is located usually performs this step. The circulating air/fluids stream lifts up the sand, mixes it with the drilling mud solution and carries it to the surface. To increase lifting capability, fluids that are more viscous may be used. The present invention also uses high viscous fluids. However, these fluids assist in moving the cuttings into the "traps."

However, even fluids with high viscosity value are unable to lift up metal cuttings. Therefore, the next conventional step is to use a milling tool that will cut away pieces of metal and allow the circulating fluid to carry them up to the surface. The tool of the present invention can be lowered into a wellbore together with the jet sub, as shown in FIG. 7 or with a milling bit, as shown in FIG. 6, thus eliminating one or even two steps of conventional methods.

By using a magnetic tool together with the milling bit the user effectively introduces the retrieval means directly into the working stream and facilitates immediate adherence of the cuttings to the magnets. Consequently, the time lost in removing the packer can be effectively minimized. The tools 10 and 100 of the present invention may be used for any length of time in the well bore. In contrast, a conventional "hydrostatic surge tool" must be retrieved and reset after a four- or five-time surge. It may take from 1 to 5 minutes to complete a surge cycle.

Even further, a "hydrostatic surge tool" can retrieve large pieces of debris but it will not allow recovery of small cuttings and other metal pieces. Since conventional tools do not have circulating capabilities, they often becomes plugged with cuttings and miscellaneous debris, which prevents proper operation and creates a hazard in the event of a "kick" or "blow-out." In contrast, the tool of the present invention, by allowing circulation, does not become plugged and will not hinder a well-killing operation.

The size and number of the magnets 122, as well as the number of magnet assemblies can vary, depending on the size of the drill string, the diameter of the annulus and the amount of cuttings to be retrieved. If desired, the magnets may be staggered or offset from each other in relation to the magnet assemblies to achieve maximum efficiency. The magnet member may be manufactured from ceramic or rare earth material, insulated and/or stainless steel coated to ensure a long service life.

It is envisioned that the tool of the present invention may be designed with magnets positioned on the interior wall of the central opening. The internal positioning will allow for reverse circulating retrieval of larger pieces of debris.

The diameter of the tool may be reduced to run with wire-line or coiled tubing, if necessary, although larger scale tools may be produced based on the principles discussed above. The tool of the present invention may be successfully run with casing scrapers, scratchers and/or brush tools when conditioning of the well bore for production equipment takes place.

The profile of the magnets positioned on the tool bodies assures 360-degree coverage with right-hand rotation. The tool will continue to work even when circulation stops and even in high temperature environment. Since the tool has no "skirts", it may be successfully employed in perforated zones without the fear of hang-ups in cased holes or where casing has splintered.

The tool connections have conventional sizes to allow connecting of the tool body with currently used drilling and work over equipment. Oversized tool joints create a centralizing effect and allow retrieval of cuttings and debris without being pulled off the tool during retrieval.

The apparatus of the present invention may be successfully used for a number of operations, such as running above reverse circulation baskets to catch miscellaneous pieces, bearings, rings, etc.; for running with fishing magnets to retrieve various items from the wellbore; for running with a mule shoe to wash sand and recover miscellaneous items; for running with milling equipment to recover cuttings from a well bore. The latter type of use has an additional benefit of keeping the cuttings away from the milling bit to allow for more efficient milling operations.

The tool of the present invention may be also used for running below a tubing conveyed perforating guns to recover shrapnel from the well bore, for running with J-latch or conventional overshot to recover miscellaneous item and retrieve packer plugs; for running with a jet sub for stirring miscellaneous debris and retrieving it to the surface, which allows recovery without wedging debris, as it happens when conventional equipment is used. The magnetic tools of the present invention can be also run in tandem in heavy milling and fishing operations. It can be successfully used for retrieval of various small tools and parts dropped accidentally into the well bore.

Due to a streamline design of the apparatus of the present invention, it can be washed over and retrieved with conventional fishing methods, if necessary. Such result cannot be achieved with conventional boot baskets that traditionally have oversized skirts. Cleaning of the tool of the present invention is relatively simple, and it can be run down hole again in a matter of minutes.

Many changes and modification can be made in the design of the present invention without departing from the spirit thereof. I, therefore, pray that my rights to the present invention be limited only by the scope of the appended claims.

I claim:

1. An apparatus for retrieving metal objects from a wellbore, comprising:

a cylindrical tool body with a central opening therethrough;

a plurality of magnet assemblies spaced longitudinally along the length of the tool body and covering a majority of surface area of said tool body, each of said magnet assemblies comprising a plurality of elongated magnet members, an exterior surface of each of said magnet members forming a settling surface for the metal objects being attracted by the magnet member, each of said magnet assemblies comprising a pair of magnet members detachably secured on said tool body, each of said magnet members having an arcuate cross section.

2. The apparatus of claim 1, wherein said tool body is provided with an upper sub located above said magnet assemblies and a lower sub located below said magnet assemblies, said upper sub and said lower sub allowing connection of said body to a drill string lowered into the wellbore.

3. The apparatus of claim 2, wherein diameter of said magnet assemblies is substantially equal to or less than an exterior diameter of said upper sub and said lower sub.

4. An apparatus for retrieving metal objects from a wellbore, comprising:

a cylindrical tool body with a central opening therethrough;

a plurality of magnet assemblies spaced longitudinally along the length of the tool body and covering a majority of surface area of said tool body, each of said magnet assemblies comprising a plurality of magnet members detachably secured on said tool body, each of said magnet members having an arcuate cross section, an exterior surface of each of said magnet members forming a settling surface for the metal objects being attracted by the magnet members.

5. The apparatus of claim 4, wherein said tool body is provided with an upper sub located above said magnet assemblies and a lower sub located below said magnet assemblies, said upper sub and said lower sub allowing connection of said body to a drill string lowered into the wellbore.

6. The apparatus of claim 5, wherein diameter of said magnet assemblies is substantially equal to or less than an exterior diameter of said upper sub and said lower sub.

* * * * *